United States Patent [19]

Hinzmann

[11] 3,996,944

[45] Dec. 14, 1976

[54] DISTRIBUTOR FOR CIGARETTE ROD MAKING MACHINES OR THE LIKE

[75] Inventor: Alfred Hinzmann, Richmond, Va.

[73] Assignee: Hauni-Werke Korber & Co., KG, Hamburg, Germany

[22] Filed: Dec. 24, 1974

[21] Appl. No.: 536,302

[52] U.S. Cl. ..... 131/109 R; 131/109 AB

[51] Int. Cl.[2] ..... A24B 7/14

[58] Field of Search ..... 131/57, 108, 109, 110; 19/97, 97.5

[56] References Cited

UNITED STATES PATENTS

| | | | |
|---|---|---|---|
| 255,494 | 3/1882 | Curtis et al. | 131/109 R |
| 485,272 | 11/1892 | Groom | 19/97 X |
| 1,003,178 | 9/1911 | Grahl | 131/109 R |
| 1,326,547 | 12/1919 | Tealc | 131/110 X |
| 1,833,285 | 11/1931 | Grupe | 131/109 R |
| 1,859,965 | 5/1932 | Gwinn | 131/109 AB |
| 2,326,793 | 8/1943 | Molins et al. | 131/109 R |
| 2,752,922 | 7/1956 | Molins | 131/109 AB |
| 3,059,650 | 10/1962 | Gamberini | 131/110 X |
| 3,844,295 | 10/1974 | David | 131/109 R |

FOREIGN PATENTS OR APPLICATIONS

| | | | |
|---|---|---|---|
| 1,106,635 | 3/1968 | United Kingdom | 131/108 |
| 516,039 | 12/1939 | United Kingdom | 131/109 AB |

*Primary Examiner*—John F. Pitrelli
*Attorney, Agent, or Firm*—Peter K. Kontler; John Kurucz

[57] ABSTRACT

A distributor for use in cigarette rod making machines has a magazine for a supply of shredded tobacco, a carded drum which draws from the magazine a continuous layer of tobacco shreds, and a device which homogenizes the layer of the drum adjacent to the magazine and comprises a strip-shaped barrier extending transversely of the layer and having a grooved surface adjacent to the exposed side of the layer and a second surface which faces the magazine and intercepts those shreds which extend beyond the grooved surface. The barrier is reciprocated transversely of the layer by a motor, and a paddle wheel is provided to return the piled-up shreds into the magazine. The carding of the drum consists of longer and shorter pins or needles which alternate with each other in the circumferential as well as in the axial direction of the drum. The layer which is homogenized during travel along the grooved surface of the barrier is thereupon converted into a narrow stream which is ready for trimming and/or wrapping into a cigarette paper web.

9 Claims, 5 Drawing Figures

DISTRIBUTOR FOR CIGARETTE ROD MAKING MACHINES OR THE LIKE

BACKGROUND OF THE INVENTION

The present invention relates to improvements in apparatus for producing a layer of fibrous particles, especially to improvements in distributors for shredded tobacco, and more particularly to improvements in apparatus which can be used in machines for the manufacture of wrapped tobacco fillers as a means for producing a homogeneous layer of shredded or otherwise comminuted tobacco particles which can be readily converted into a narrow tobacco stream.

The distributor of a cigarette rod making machine normally comprises a magazine for a supply of shredded tobacco, a carded drum which draws a continuous layer of tobacco particles from the magazine, means for segregating lighter particles of the layer from heavier particles and for assembling the lighter particles into a wide carpet or sliver, and means for showering the leading edge of the sliver into a narrow channel to form a continuous tobacco stream.

It was already proposed to enhance the homogeneousness of the layer which is being withdrawn from the magazine of a distributor for shredded tobacco by subjecting the layer to a series of smoothing, combing, compacting and surplus-removing treatments. Such treatments are expensive because they are carried out by resorting to a relatively complex equipment which comprises a substantial number of discrete units and occupies a substantial amount of space. Moreover, the just described treatment cannot guarantee the formation of a tobacco layer which can be converted into a filler without any further treatment, especially trimming by one or more equalizing devices. Still further, the just described treatment does not guarantee the formation of a layer which is free of holes or gaps and wherein the homogenization is effected without any or with minimal comminution of tobacco shreds.

SUMMARY OF THE INVENTION

An object of the invention is to provide a novel and improved apparatus, especially a distributor for shredded tobacco, which can convert a supply of randomly distributed fibrous particles into a highly homogeneous layer in a small area, by resorting to a small number of simple instrumentalities, and without excessive or without any comminution of the particles.

Another object of the invention is to provide an apparatus of the just outlined character wherein a small number of parts perform functions which are performed in conventional apparatus by a larger number of bulkier, more expensive and more complex components.

A further object of the invention is to provide novel and improved means for homogenizing a wide layer of tobacco shreds on a carded drum or an analogous conveyor.

An additional object of the invention is to provide novel and improved tobacco homogenizing means which can be installed in existing distributors of cigarette rod making or analogous machines as a superior substitute for heretofore used homogenizing means.

The invention is embodied in an apparatus for producing a homogeneous layer of fibrous particles, particularly in a distributor for shredded tobacco. The improved apparatus comprises a magazine or an analogous source of fibrous particles, a conveyor (e.g., a rotary carded drum) having means for withdrawing from the source a continuous layer of fibrous particles and for advancing the layer in a predetermined direction and along a predetermined path wherein the layer has an exposed side, and novel means for homogenizing the layer, preferably immediately adjacent to the outlet of the source. The homogenizing means comprises a preferably strip-shaped barrier having a preferably profiled first surface which is adjacent to and in contact with the exposed side of the layer and a second surface which is adjacent to the first surface, which extends substantially transversely of the path for the layer, and which faces counter to the direction of transport of the layer so that at least some particles of the layer which extend beyond the first surface are intercepted by and pile up at the second surface. The homogenizing means further comprises means for moving the barrier back and forth substantially transversely of the path that the first surface reciprocates along and transversely of the exposed side of the moving layer, and a paddle wheel or analogous refuser means for moving the piled-up particles counter to the direction of movement of the layer and preferably directly into the source.

The barrier preferably comprises a third surface which is remote from the first surface and along which the paddles of the refuser means move to thereby compact the pile of intercepted particles at the second surface and to return the top of the pile back into the source. The second surface is disposed between the first and third surfaces, and the profile of the first surface preferably exhibits recesses which extend in the direction of movement of the layer and are adjacent to the second surface of the barrier.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4, 5:
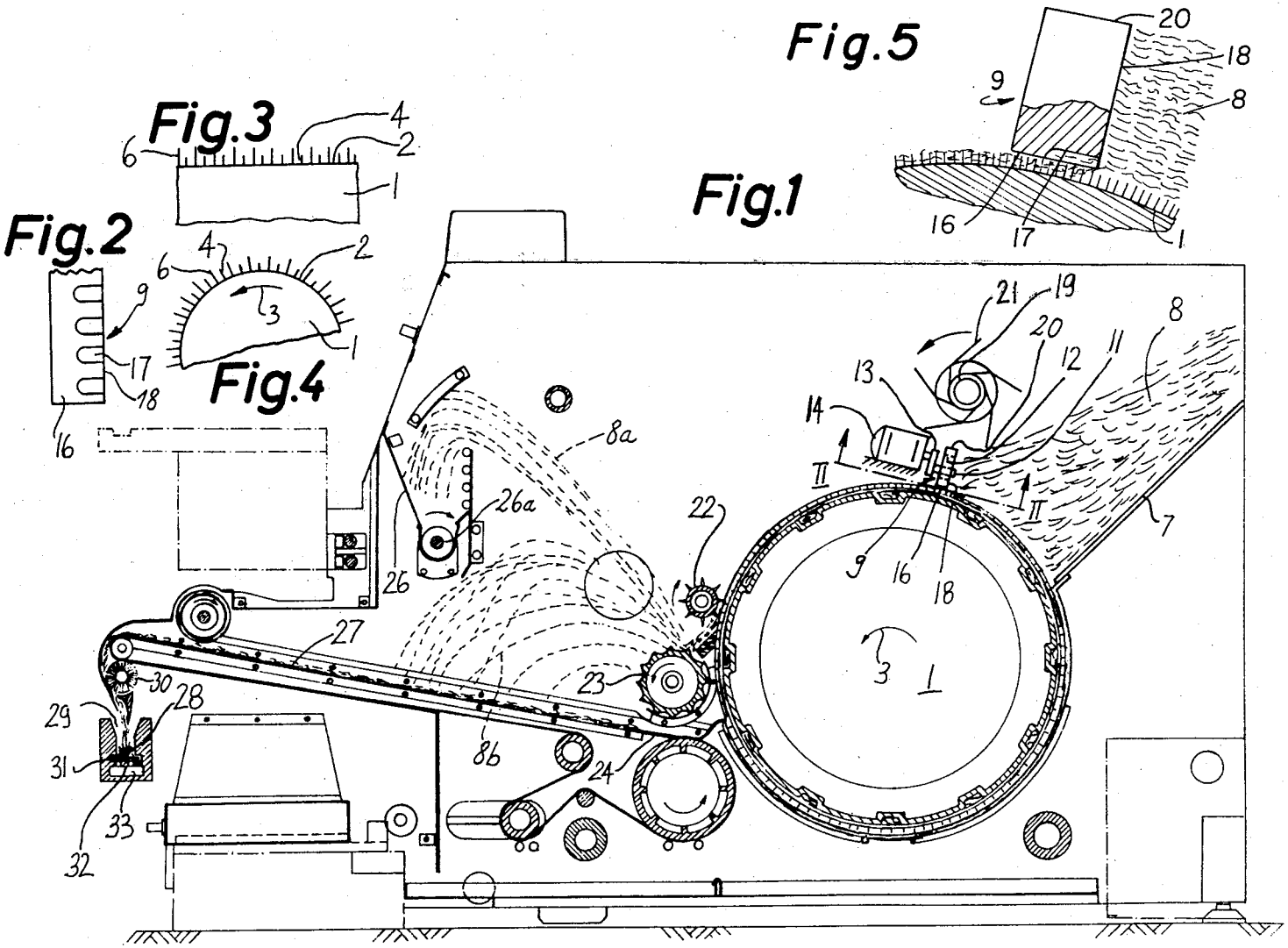
FIG. 1 is a schematic fragmentary partly elevational and partly vertical sectional view of a cigarette rod making machine having a distributor which embodies the invention.
FIG. 2 is a fragmentary bottom plan view of the barrier, substantially as seen in the direction of arrows from the line II—II of FIG. 1.
FIG. 3 is a fragmentary schematic axial sectional view of a carded drum in the distributor of FIG. 1.
FIG. 4 is a smaller-scale fragmentary schematic and elevational view of the drum.
FIG. 5 is an enlarged partly elevational and partly sectional view of a detail in the distributor of FIG. 1.

FIG. 1 shows a distributor which can be used in a cigarette rod making machine of the type known as GARANT (trademark) produced by Hauni-Werke Korber & Co. KG, of Hamburg-Bergedorf, Western Germany. The distributor comprises a magazine 7 constituting a source of shredded tobacco particles 8. An endless conveyor 1, here shown as a carded drum, has particle-entraining projections 4 and 6 (FIGS. 3 and 4) which constitute a means for withdrawing from the magazine 7 a continuous layer of tobacco shreds. Such layer advances along a predetermined path defined by the peripheral surface 2 of the drum 1 and in the direction indicated by arrow 3. The longer projections 6 of the drum 1 preferably alternate with the shorter projections 4, as considered in and transversely of the direction of lengthwise movement of the tobacco layer.

The means for homogenizing the tobacco layer comprises an elongated strip-shaped barrier 9 which extends transversely of the tobacco layer and is closely adjacent to the magazine 7. As shown, the barrier 9 is parallel to the axis of the drum 1 and has a profiled first surface 16 which is adjacent to the exposed side of the tobacco layer. The elongated recesses in the form of relatively shallow flutes or grooves 17 profile of the surface 16 exhibits (FIGS. 2 and 5) which are machined into the surface 16 and are shorter than this surface, as considered in the direction of lengthwise movement of the tobacco layer. For example, the length of each recess 17 may equal or approximate half the length of the surface 16. The open deeper ends of the recesses 17 are adjacent to a second surface 18 of the barrier 9; this second surface extends transversely of the layer and faces counter to the direction of rotation of the drum, i.e., toward the magazine 7. A third surface 20 of the barrier 9 is remote from the first surface 16 and is adjacent to a rotary paddle wheel 19 which constitutes a refuser and has preferably flexible paddles or blades 21 orbiting in a counterclockwise direction, as viewed in FIG. 1. The surface 18 is disposed between the surfaces 16, 20 and the barrier 9 has a substantially vertically extending slot 12 for the pin 11 of a crankshaft 13 which is driven by a prime mover 14 (e.g., an electric motor) so as to reciprocate the barrier in parallelism with the axis of the drum 1. The means for guiding the barrier 9 against movement other than transversely of the tobacco layer is not shown in the drawing. The prime mover 14 can also serve to transmit torque to the shaft of the refuser wheel 19 but it is equally within the perview of the invention to rotate the refuser wheel by a separate prime mover, e.g., by the main prime mover of the cigarette rod making machine which includes the improved distributor.

The operation of the heretofore described parts of the distributor is as follows:

The drum 1 is driven by the main prime mover of the cigarette rod making machine to rotate counterclockwise, as viewed in FIG. 1, whereby its projections 4 and 6 withdraw from the magazine 7 a continuous layer of tobacco particles 8, and such layer advances toward and its exposed upper side passes beneath the surface 16 of the reciprocating barrier 9. The projections 4 and 6 of the drum 1 preferably draw tobacco particles at such a rate that the height or thickness of the layer on the peripheral surface 2 of the drum exceeds the desired thickness of the homogenized layer. Therefore, at least some particles 8 of the surplus are intercepted by and pile up along the surface 18 of the barrier 9. Since the latter reciprocates in parallelism with the axis of the drum 1, and since its layer-contacting surface 16 is profiled, the barrier effects a desirable distribution of tobacco particles 8 along the full axial length of the drum 1 with resulting homogenization of the tobacco layer. The recesses 17 insure that the particles 8 which are allowed to advance beyond the barrier 9 completely cover the peripheral surface 2 of the drum 1 and are uniformly distributed between and retained and advanced by the projections 4 and 6 beyond the surface 16. As a rule, the thus distributed particles 8 form a relatively wide but relatively thin layer or carpet which is practically or completely free of gaps and is suited for conversion into a highly satisfactory tobacco stream.

The refuser wheel 19 causes its paddles or blades 21 to travel seriatim along the surface 20 of the reciprocating barrier 9 and to sweep the piled-up surplus tobacco particles back toward and preferably directly into the magazine 7. It will be seen that the paddles 21 insure that the surface 18 of the reciprocating barrier 9 invariably or nearly invariably intercepts and blocks the forward movement of a body or pile of tobacco particles 8 whose height is constant, as considered in the radial direction of the drum 1. Such uniformization of the piled-up tobacco particles also contributes to homogeneousness of the layer which is allowed to advance beyond the profiled surface 16 of the barrier 9. It has been found that the provision of barrier 9, in combination with the refuser wheel 19, suffices to insure proper compacting of tobacco particles in and immediately in front of the gap between the drum 1 and surface 16 so that such particles need not be urged against the surface 2 by auxiliary tamping or compacting means.

The particles which form the homogenized layer downstream of the barrier 9 are separated from the projections 4 and 6 by a rapidly rotating picker roller 22 which propels the particles against a rapidly rotating winnower 23 serving as a means for segregating heavier tobacco particles 8*a* from ligher tobacco particles 8*b*. The flight spans of the heavier particles 8*a* are longer and such particles are deflected into and intercepted and collected by a trough-shaped receptacle 26 wherein a screw 26*a* rotates about an axis extending at right angles to the plane of FIG. 1 to convey the heavier particles to a further processing station, e.g., into a machine for the production of a web of reconstituted tobacco. The lighter particles 8*b* descend onto the upper reach of a wide conveyor belt 24 to form thereon a sliver 27. The latter is converted into a narrow tobacco stream 28 in the following way: The leading edge of the sliver 27 advances beyond the upper reach of the belt 24 and descends into the range of bristles on a rapidly rotating cylindrical brush 30. The bristles propel the particles 8*a* of the sliver 27 into a narrow tobacco channel 29 disposed above the upper reach of a narrow airpermeable band conveyor 31; such upper reach moves above the perforated top wall 32 of a stationary suction chamber 33 which draws air through the openings of the wall 32 and conveyor 31 and thus insures that the growing tobacco stream 28 is attracted to and advances with the conveyor 31 toward and past a trimming device, not shown, or directly into the wrapping mechanism of the cigarette rod making machine.

An advantage of the improved distributor is that the barrier 9 cooperates with the refuser wheel 19 to automatically condense the particles of tobacco in the region of the surface 18 so that the particles are urged against the peripheral surface 2 of the rotating drum 1. This insures the formation of a tobacco layer having a constant thickness and density. Moreover, the barrier 9 cooperates with the projections 4 and 6 of the drum 1 to form a homogeneous layer wherein longer and shorter particles of tobacco are distributed with a high degree of uniformity and without undergoing a comminuting action.

The improved distributor is susceptible of many modifications without departing from the spirit of the invention. For example, the barrier 9 may be moved back and forth by other types of reciprocating means, the carding of the drum 1 may comprise projections or needles of maximum, medium and minimum length, and the winnower 23 can be omitted if the particles of stem, ribs, birds' eyes or foreign matter (such as fragments of metal or rock) are segregated from tobacco prior to admission into the magazine 7. The drum 1 may be replaced with an endless belt conveyor having a carding similar or analogous to that shown in FIGS. 3 and 4.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In an apparatus for producing a homogeneous layer of fibrous particles, particularly in a distributor for shredded tobacco, the combination of a source of fibrous particles; a conveyor having means for withdrawing from said source a continuous layer of fibrous particles and for advancing said layer in a predetermined direction and along a predetermined path wherein said layer has an exposed side; and means for homogenizing said layer including a barrier having a continuous uninterrupted first surface adjacent to and in contact with the exposed side of said layer, a second surface adjacent to said first surface, extending substantially transversely of said path and facing counter to said direction so that at least some particles of said layer which extend beyond said first surface are intercepted by and pile up at said second surface to form a supply of particles immediately upstream of said first surface, and a third surface coextensive with and remote from said first surface, said second surface being disposed between said first and third surfaces, means for moving said barrier substantially transversely of said path, said first surface of said barrier having raised and recessed portions which homogenize said layer between said first surface and said conveyor as a result of said movement of said barrier transversely of said path and allow all fibrous particles which advance beyond said second surface to move along and beyond said first surface, and refuser means for moving the surplus of piled-up particles of said supply counter to said direction, said refuser means being adjacent to said third surface so that the height of said supply of particles is at least substantially constant and equals the width of said second surface.

2. The combination of claim 1, wherein said second surface is adjacent to said source so that the particles which are moved by said refuser means reenter said source.

3. The combination of claim 1, wherein said reciprocating means comprises a prime mover and a crankshaft driven by said prime mover and operatively connected with said barrier.

4. The combination of claim 1, wherein said refuser means comprises a rotary paddle wheel.

5. The combination of claim 1, wherein said conveyor is an endless conveyor and said withdrawing means comprises a carding having relatively long first and relatively short second particle-entraining projections, said first and second projections alternating with each other in and transversely of said direction.

6. The combination of claim 5, wherein said conveyor is a rotary drum having a peripheral surface and said projections extend from said peripheral surface.

7. The combination of claim 1, wherein said recessed portions of said first surface are elongated grooves extending in substantial parallelism with said direction.

8. The combination of claim 7, wherein the length of said first surface, as considered in said direction, exceeds the length of said grooves.

9. The combination of claim 8, wherein said grooves are adjacent to said second surface.

* * * * *

UNITED STATES PATENT OFFICE
CERTIFICATE OF CORRECTION

Patent No. 3,996,944 Dated December 14, 1976

Inventor(s) Alfred HINZMANN

It is certified that error appears in the above-identified patent and that said Letters Patent are hereby corrected as shown below:

Foremost page, left-hand column, item [73], "Hauni-Werke Korber & Co., KG," should read --Hauni-Werke Körber & Co. KG.--.

Abstract, line 5, "of" should read --on--.

Col. 2, line 19, --so-- should be inserted after "path";
line 55, "and" should read --end--;
line 65, "Korber" should read --Körber--.

Col. 3, line 16, "elongated recesses in the form of" should be deleted;
line 17, "relatively shallow flutes or grooves 17" should be deleted;
line 18, --elongated recesses in the form of relatively shallow flutes or grooves 17-- should be inserted after "exhibits";
line 42, "perview" should read --purview--.

Col. 4, line 49, "airpermeable" should read --air-permeable--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*